US006434985B1

(12) United States Patent
Walmsley

(10) Patent No.: US 6,434,985 B1
(45) Date of Patent: Aug. 20, 2002

(54) SECURITY GRILLE LOCKING SYSTEM

(75) Inventor: Joseph Reginald Walmsley, Oatlands (AU)

(73) Assignee: Exodus Innovations PTY Limited, Watsons Bay (AU)

( * ) Notice: Subject to any disclaimer, the term of this patent is extended or adjusted under 35 U.S.C. 154(b) by 0 days.

(21) Appl. No.: 09/870,187

(22) Filed: May 30, 2001

(51) Int. Cl.[7] ..... E05B 47/08

(52) U.S. Cl. ..... 70/277; 49/35; 70/278.1; 70/278.7; 70/283

(58) Field of Search ..... 49/35; 70/277, 70/278.1, 278.6, 278.7, 279.1, 283

(56) References Cited

U.S. PATENT DOCUMENTS

| | | | | | |
|---|---|---|---|---|---|
| 2,940,292 | A | * | 6/1960 | Heath | 70/241 |
| 4,685,316 | A | * | 8/1987 | Hicks et al. | 70/279.1 X |
| 4,840,050 | A | * | 6/1989 | Gotanda | 70/107 |
| 4,917,419 | A | * | 4/1990 | Mora, Jr. et al. | 70/279.1 X |
| 4,956,984 | A | * | 9/1990 | Chi-Cheng | 70/277 |
| 5,943,888 | A | * | 8/1999 | Lawson | 70/278.7 |

* cited by examiner

*Primary Examiner*—Lloyd A. Gall

(74) *Attorney, Agent, or Firm*—Abelman, Frayne & Schwab

(57) ABSTRACT

A locking assembly is provided for a pivotally openable window or door security grille (14, 82) of a building. To unlock the security grille (14, 82), a user operates an electric punch key pad (52) to cause a solenoid rod (168) to disengage a depression (182) and the operates a handle (54) to cause an actuator support bracket (100) to pivot in a forward direction from a first reference location to a second reference location against the influence of a coil spring (132), whereby a catch surface (130) no longer engages against a shaft member (26) which is free to leave a lockable location and allow the security grille (14, 82) to be pivoted to an opened position, and whereafter a slidable pin (152) engages a depression (150) under the influence of a coil spring (156). To lock the security grille (14, 82), the user pivots the security grille (14, 82) to a closed position so as to cause the shaft member (26) to apply a force against the slidable pin (152) that disengages the slidable pin (152) from the depression (150) against the opposing influence of the coil spring (156), whereby the actuator support bracket (100) is caused to pivot in a reverse direction from the second reference location to the first reference location under the influence of the coil spring (132) until the catch surface (130) engages against the shaft member (26) so as to prevent the shaft member (26) leaving the lockable location, and whereafter the solenoid rod (168) reengages the depression (182).

7 Claims, 6 Drawing Sheets

SECURITY GRILLE LOCKING SYSTEM

FIELD OF INVENTION

The present invention relates to security grille locking systems for windows, doors and the like building openings, and, in particular, to pivoting, lockable window security grilles that may be opened when required, say, in cases of emergency to allow persons to escape the building through the window. The present invention more particularly relates to a locking assembly for window and door security grilles.

BACKGROUND OF THE INVENTION

Commonly, unlawful entry into buildings is facilitated through windows. Conventional window locks only prevent the prising open of the window from the outside by manipulation of its frame. Window locks are ineffective where the objective is to smash the window glass. Once the glass is smashed, the intruder may clear a way through the window to enter the building or extend their arm around the broken glass to manipulate the lock.

Security grilles provide a more secure, if less aesthetically pleasing, means of preventing unlawful entry through windows. However, not all security grilles are pivotally openable from adjacent the window, and those which do have this feature are, in the main, difficult to open or unreliable to operate because of shortcomings in the locking assembly.

It is an object of the present invention to provide a locking assembly for pivotally openable window and door security grilles which will enable such grilles to easily and rapidly open so as to allow the occupants of the building to readily escape the building in case of an emergency.

It is a preferred object of the present invention to provide a locking assembly for pivotally openable window and door security grilles that may be operated from both the inside and outside of a building.

SUMMARY OF THE INVENTION

According to the invention, there is provided a locking assembly for a pivotally openable window or door security grille of a building, comprising:

an electronic punch key pad operable from within the building, a solenoid means having a solenoid rod retractable by operation of the electronic punch key pad, a locking shaft means secured at a first end thereof to the security grille, and including a shaft member at its second end thereof, the shaft member adapted to reach a lockable location when the security grille is pivoted from an opened position to a closed position, an actuator support bracket to which the solenoid means is mounted, the actuator support bracket being adapted to pivot in a forward direction from a first reference location to a second reference location so as to facilitate unlocking of the security grille and to pivot in a reverse direction from the second reference location to the first reference location so as to facilitate locking of the security grille, the actuator support bracket also having mounted thereon a slidable pin adapted to extend in a first longitudinal direction under the influence of first spring bias means and to retract in a second longitudinal direction opposite the first longitudinal direction under force applied by the shaft member of the locking shaft means when the security grille is pivoted from the opened position to the closed position, the actuator support bracket further including a catch surface adapted to engage against the shaft member of the locking shaft means so as to prevent the shaft member leaving the lockable location, first stop means for controllably preventing the actuator support bracket pivoting in the forward direction from the first reference location to the second reference location, second stop means for controllably preventing the actuator support bracket pivoting in the reverse direction from the second reference location to the first reference location, handle means operable from within the building to enable the actuator support bracket to pivot from the first reference location to the second reference location, and second spring bias means adapted to oppose the actuator support bracket pivoting from the first reference location to the second reference location when the first stop means no longer prevents the actuator support bracket pivoting in the forward direction, the arrangement being such that; to unlock the security grille, a user operates the electronic punch key pad to cause the solenoid rod to disengage the first stop means and then operates the handle means to cause the actuator support bracket to pivot in the forward direction from the first reference location to the second reference location against the influence of the second spring bias means, whereby the catch surface no longer engages against the shaft member which is free to leave the lockable location and allow the security grille to be pivoted to an opened position, and whereafter the slidable pin engages the second stop means under the influence of the first spring bias means; and to lock the security grille, the user pivots the security grille to a closed position so as to cause the shaft member to apply a force against the slidable pin that disengages the slidable pin from the second stop means against the opposing influence of the first spring bias means, whereby the actuator support bracket is caused to pivot in the reverse direction from the second reference location to the first reference location under the influence of the second spring bias means until the catch surface engages against the shaft member so as to prevent the shaft member leaving the lockable location, and whereafter the solenoid rod reengages the first stop means.

BRIEF DESCRIPTION OF THE DRAWINGS

In order that the invention may be readily understood and put into practical effect, reference will now be made to the accompanying drawings, in which.

DETAILED DESCRIPTION OF THE INVENTION

Figure 1:
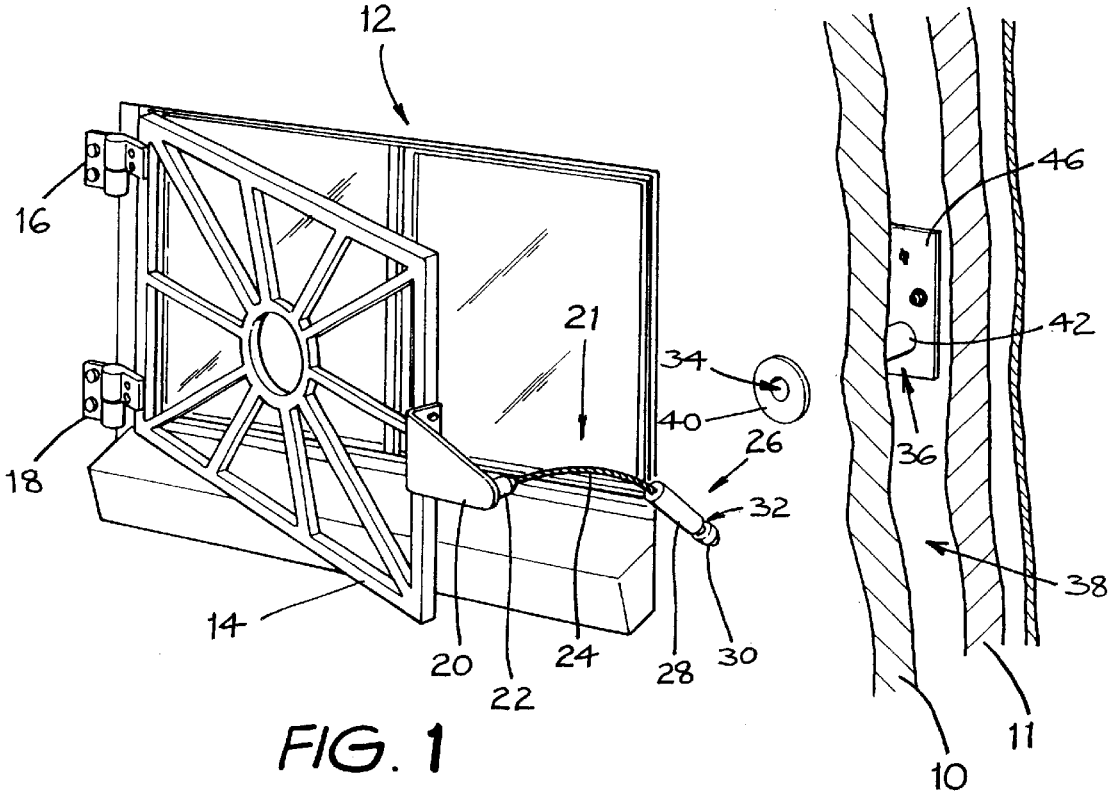
FIG. 1 is a perspective view from the outside of a building showing a cut-away portion of the building wall structure on which is located a window, a pivotally openable window security grille, and part of a Referred locking assembly therefor.
Figure 2:
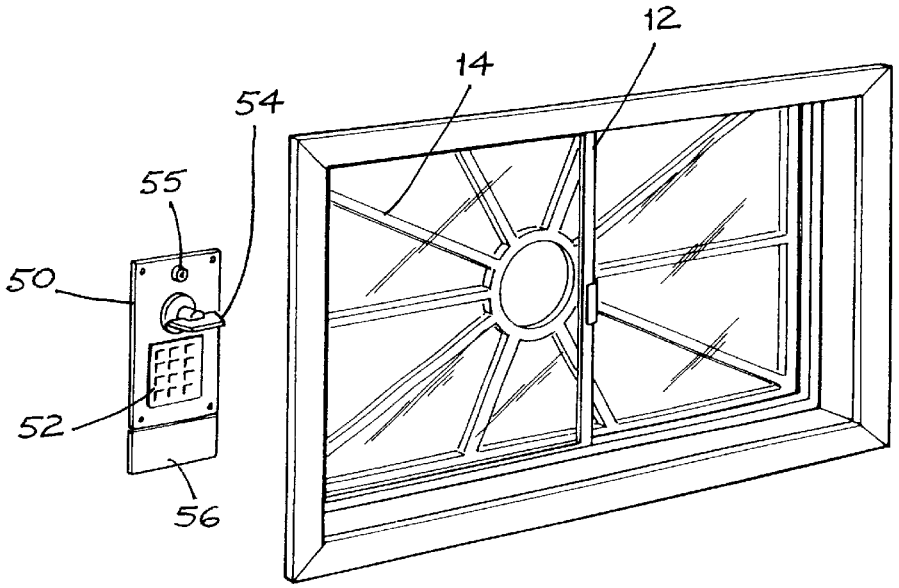
FIG. 2 is a perspective view from the inside of the building showing the window and security grille of FIG. 1, and another part of the preferred locking assembly therefor.

The building wall structure shown in FIGS. 1 and 2 consists of an outside wall 10, an inside wall 11, and has mounted thereto a window 12, a window security grille 14 and various components of a locking assembly for controlling the opening and locking of the grille 14. The grille 14 is pivotally connected to the outside wall 10 by a pair of conventional hinge structures 16,18 that enable the grille 14 to be pivotally opened away from the window 12 when the locking assembly is in an opened position.

Secured to the grille 14 is an extension bracket 20 to which is connected a locking shaft structure 21. The locking shaft structure 21 consists of a cable mounting member 22, to which is attached a flexible cable 24. The cable 24 is secured at its end remote from the mounting member 22 to a shaft member 26 having a cylindrical main body portion 28, a substantially conical leading head portion 30, and an annular groove portion 32 therebetween.

The locking shaft structure 21 is adapted to pass through a passageway 34 defined by a substantially tubular open ended connecting structure 36 that communicates from the outer side of the outside wall 10 of the building to the cavity side of the inside wall 11 of the building via the cavity or wall space 38 therebetween.

Figure 5:
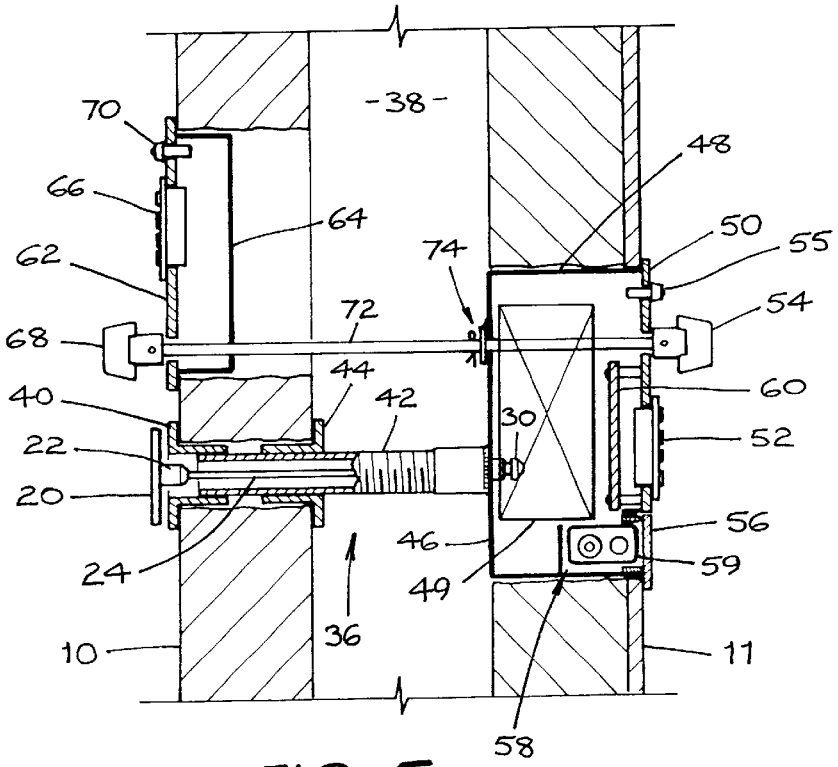
FIG. 5 is a sectional view through the building wall structure shown in FIG. 3, and optionally through the building wall structure shown in FIG. 1, showing the preferred locking assembly.
Figure 6:
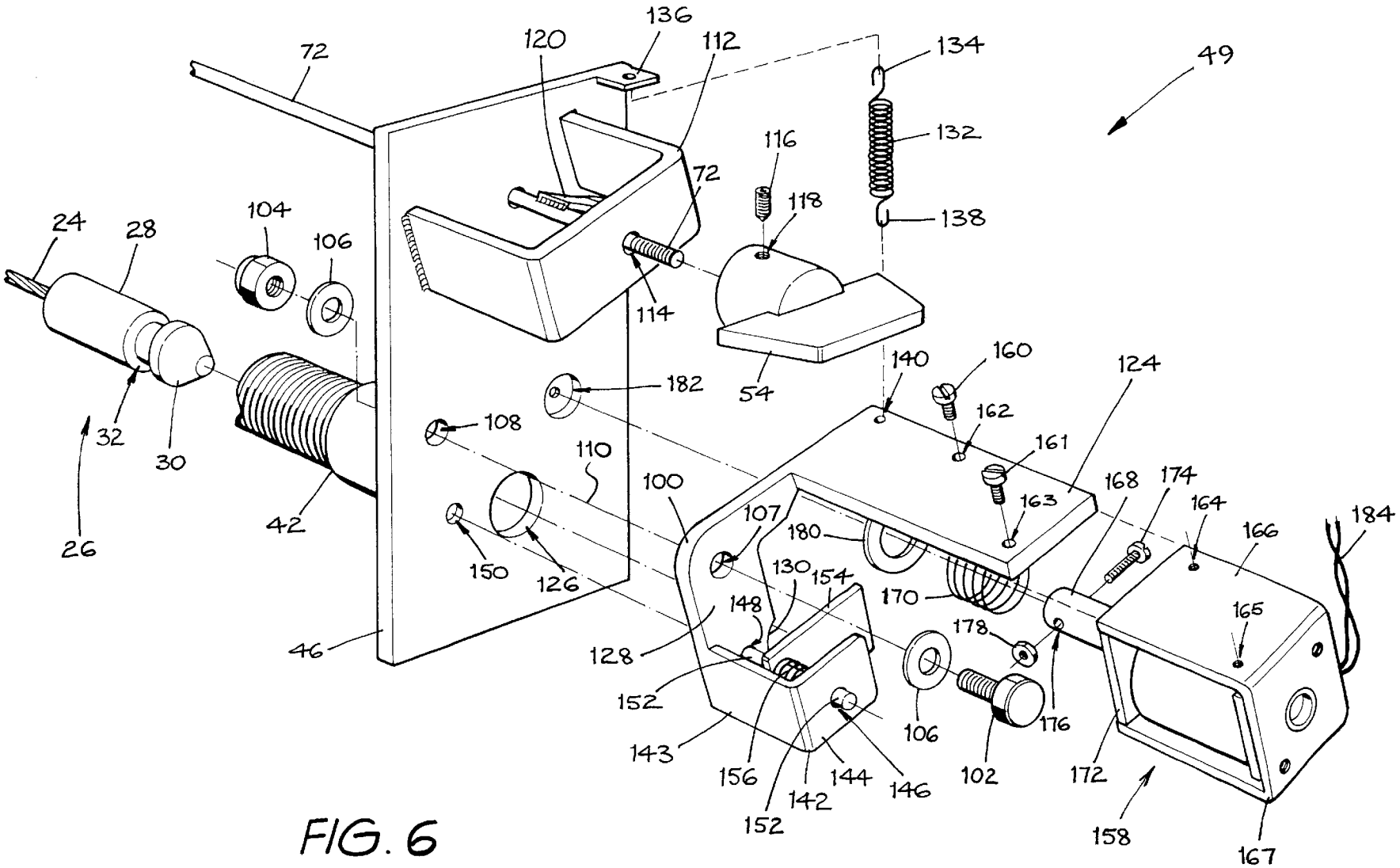
FIG. 6 is an exploded perspective view of the main locking mechanism for the locking assembly shown in FIG. 5.
Figure 8:
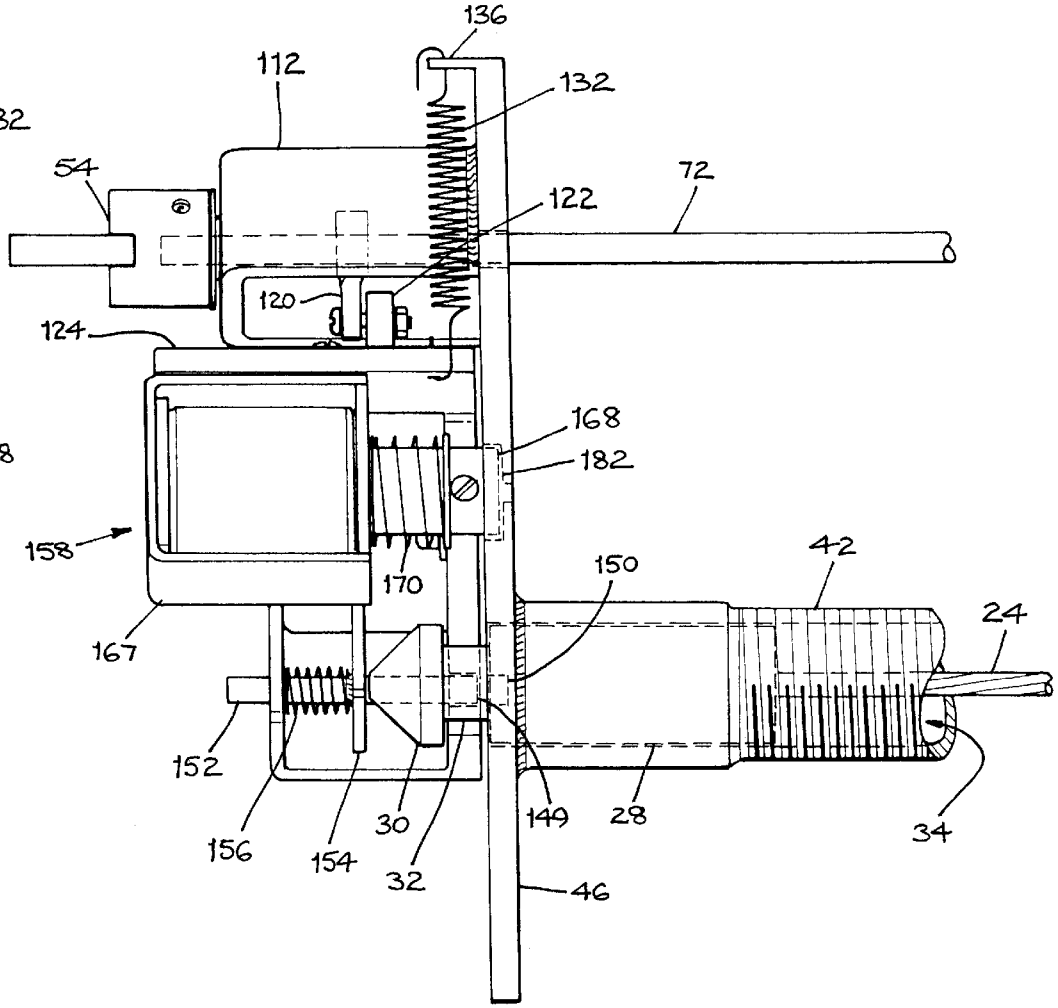
FIG. 8 is a side view of the locking mechanism (when assembled) of FIG. 6 when in the locked position, FIG. 9 an end view similar to that of FIG. 7, but in which the locking mechanism is in an opened position, and FIG. 10 aside view similar to that of FIG. 8, but in which the locking mechanism is in an opened position.
Figure 7:
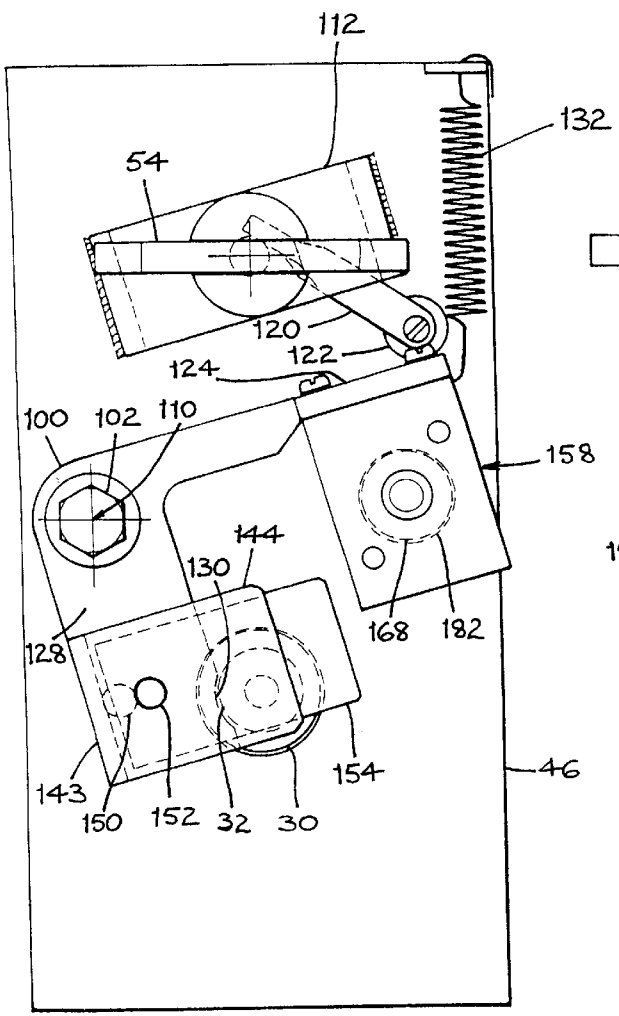
FIG. 7 is an end view of the locking mechanism (when assembled) of FIG. 6 from the end facing the inside of the building, in which the locking mechanism is in a locked position.
Figure 10:
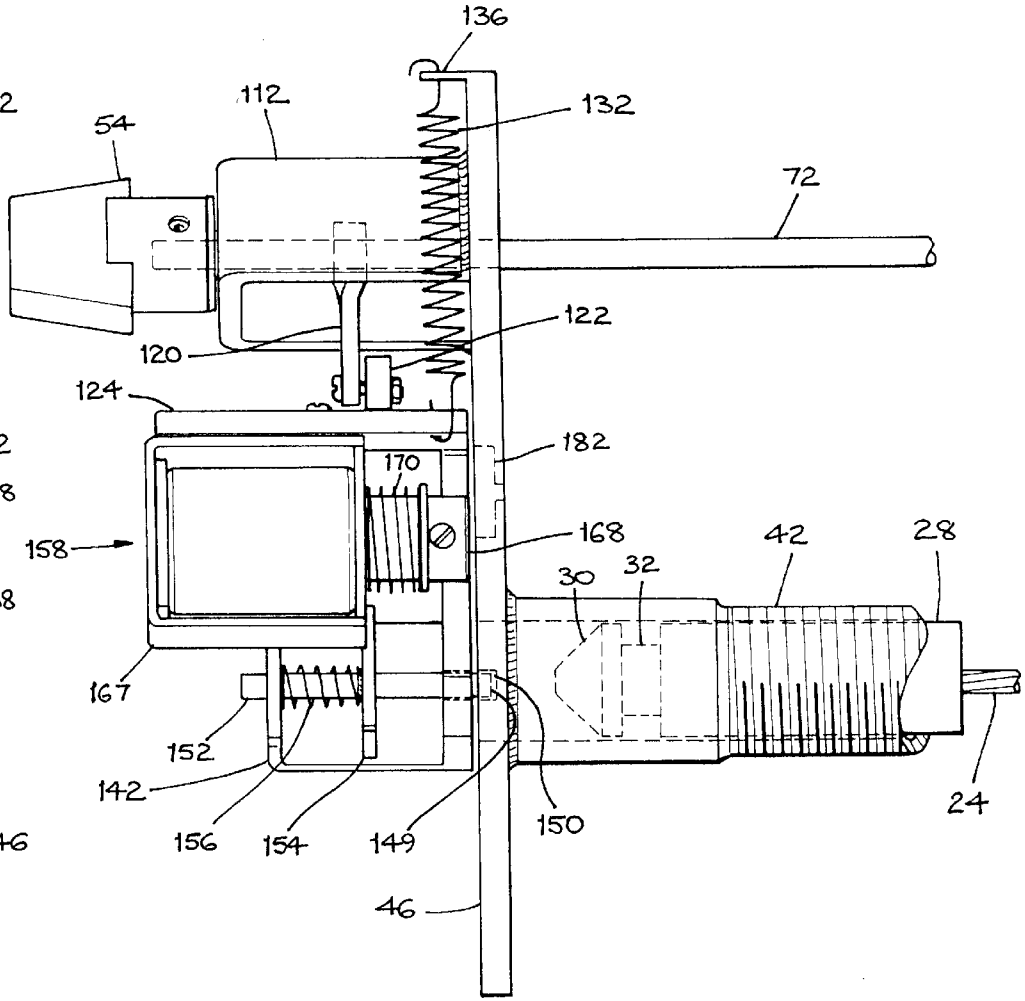
Figure 9:
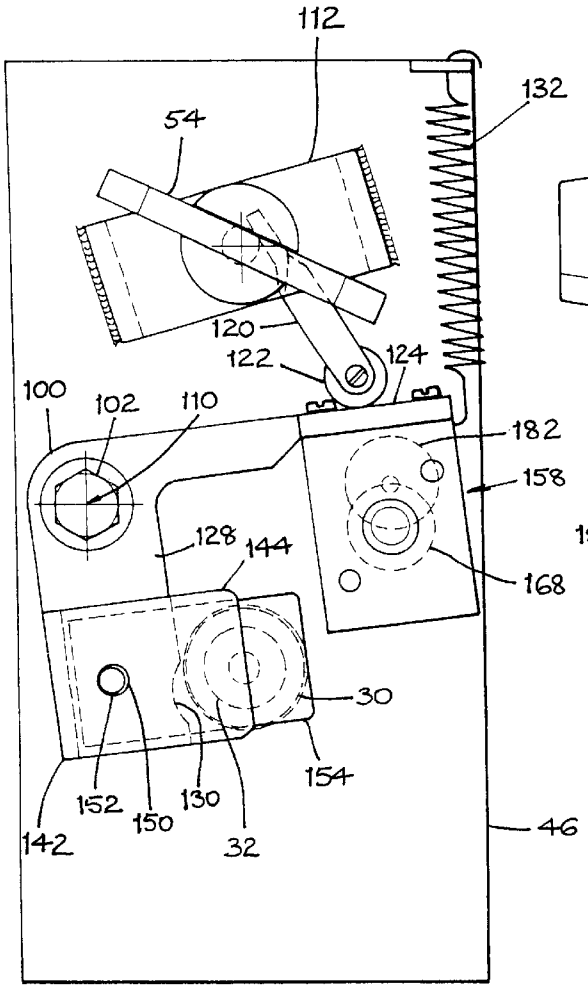

As shown in FIG. 5, the substantially tubular connecting structure 36 includes a first flanged piece 40 defining the entrance or outer opening of the passageway 34 and which receives therein a forward portion of an outwardly threaded tubular member 42 of the structure 36. The structure 36 also includes a second flanged piece 44 which is threadably engaged to the tubular member 42 and which abuts against the cavity side of the outside wall 10. The first flanged piece 40 may also be threaded so that the co-operative threading of both the first and second flanged pieces 40 and 44 with the tubular member 42 allow the locations of the flanged pieces 40, 44 on the tubular member 42 to be adjusted to suit varying thicknesses of outside walls.

The rearward portion of the tubular member 42 is secured against a mounting panel 46 of a housing or enclosure 48 for a locking mechanism 49 shown in FIGS. 6 to 10. As shown in FIG. 5, enclosure 48 extends through the inside wall 11 and has an interior facing panel 50 from which is mounted manually operable and visible components of the locking assembly which are accessible from the inside of the building, which components comprise an electronic touch key pad 52, a rotatable handle 54, and an on-off lamp 55. A lower part 56 of the facing panel 50 is removable to reveal a battery compartment 58 located within the enclosure 48 for housing one or more batteries 59 adapted to provide power to the locking assembly. Secured behind the key pad 52 is an electronic circuit board 60 for the key pad 52.

In the case of the door grille, and optionally in the case of the window grille, there is secured against the outside wall an exterior facing panel 62 of an enclosure 64 extending partly through the outside wall 10, as shown in FIG. 5. Mounted from the exterior facing panel 62 are manually operable and visible components of the locking assembly which are accessible from the outside of the building, which components comprise an electronic touch key pad 66, a rotatable handle 68, and an on-off lamp 70. The key pad 66 and on-off lamp 70 have power thereto supplied from the one or more batteries 59 housed in compartment 58, and the key pad 66 shares the same circuit board 60 as the key pad 52.

The rotatable handles 54, 68 are interconnected by a rod 72 such that the rotation of one of the handles 54, 68 will cause the other one of the handles 54, 68 to rotate in unison. The rod 72 passes through apertures at the rear of the enclosures 48, 64 and there is a stop pin and washer arrangement 74 adjacent the aperture at the rear of enclosure 48 to prevent longitudinal movement of the rod 72, and so protect against tampering.

Figure 3:
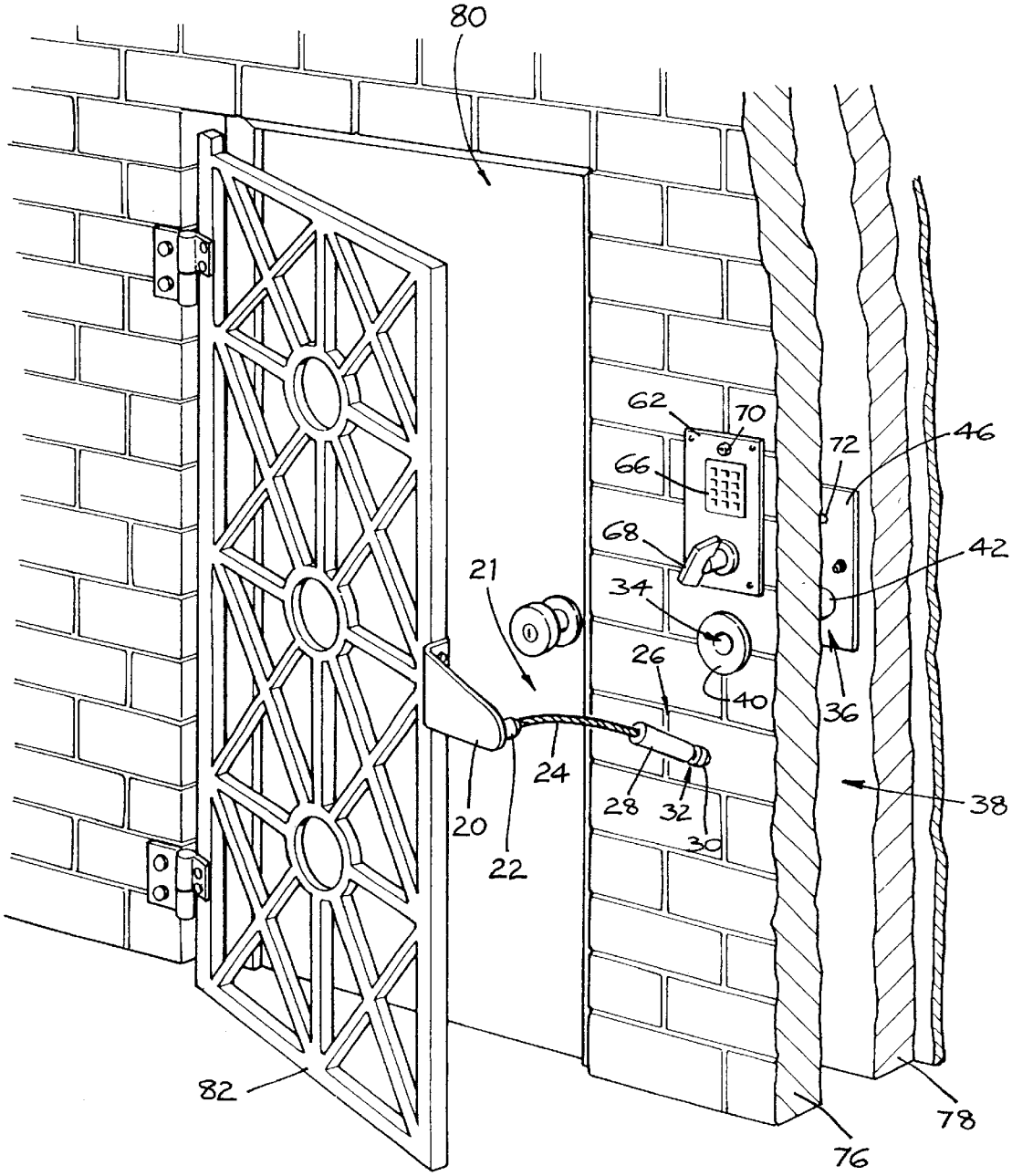
FIG. 3 is a perspective view from the outside of a building showing a cut-away portion of the building wall structure on which is located a door, a pivotally openable door security grille, and part of a preferred locking assembly therefor.
Figure 4:
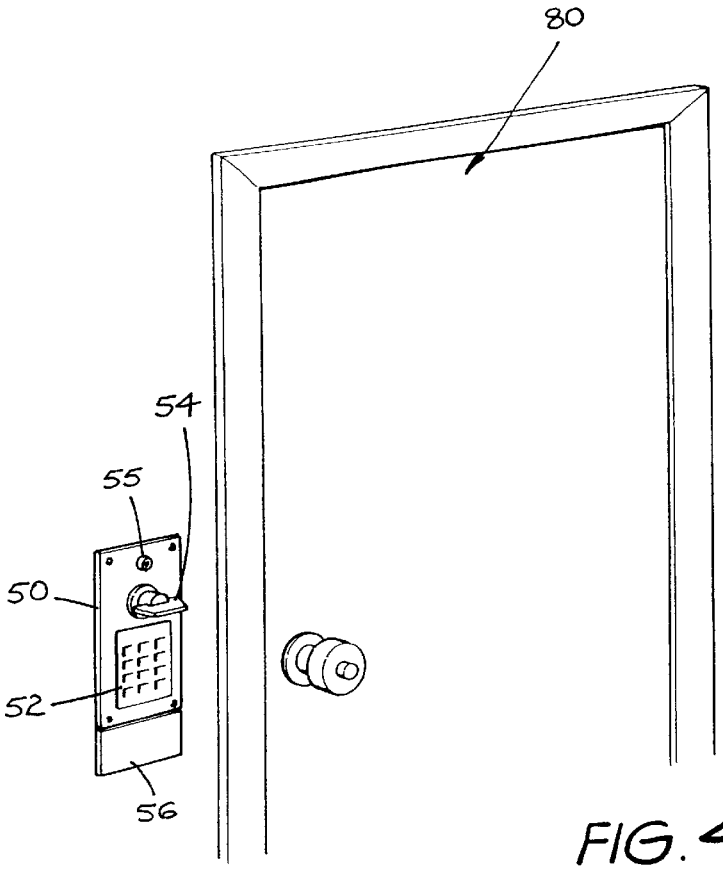
FIG. 4 is a perspective view from the inside of the building showing the door of FIG. 3, and another part of the preferred locking assembly therefor.

The building wall structure shown in FIGS. 3 and 4 (as with that of FIGS. 1 and 2), consists of an outside wall 76, an inside wall 78, and has mounted thereto a door 80, a door security grille 82, and various components of a locking assembly for controlling the opening and locking of the grille 82. The door security grille 82 opens in a similar way to the window security grille 14 of FIGS. 1 and 2, and the various components of the locking assembly for controlling the opening and locking of the door security grille 82 are substantially identical, in structure and function, to the locking assembly components for the window security grille 14 described above by reference to FIGS. 1, 2 and 5, with the exception, optionally, that the window security grille locking assembly lacks components that will enable the window grille to be opened by operation of the locking assembly from the outside of the building. Hence, the structure and function of the locking assembly for controlling the opening and locking of the door security grille 82 will not be described separately, but can be readily understood by reference to the description of FIGS. 1, 2 and 5. For the sake of brevity, identical numerals appearing in FIGS. 3 and 4 to those appearing in FIGS. 1 and 2 denote substantially identical features.

The locking mechanism 49 shown in FIGS. 6 to 10 (which locking mechanism is equally suited to operate in a locking assembly for either the window or door security grilles 14, 82), has an actuator support bracket 100 pivotally connected to the mounting panel 46 by an arrangement of nut 102, bolt 104 and washers 106,107, the nut 102 passing through aperture 107 in the support bracket 100 and through aperture 108 in the mounting panel 46 so that the support bracket 100 can pivot about axis 110. A stop bracket 112 is welded to the mounting panel 46 and has an aperture 114 through which the rod 72 passes. The handle 54 is threadably engaged with the rod 72 and may be stably fixed thereto by the action of a screw 116 inserted into hole 118 aligned perpendicularly to the rod 72. The rod 72 has secured thereto a projecting arm 120, that rotates about the longitudinal axis of the rod 72 when the handle 54 (or handle 68) is rotated.

The rotating stroke of the projecting arm 120 is limited in its upward extent by the stop bracket 112. The end of the projecting arm 120 remote of the rod 72 has a roller bearing arrangement 122 attached thereto (see FIGS. 7 to 10).

The roller bearing arrangement 122 is adapted to urge against and roll over the upper surface of a first limb portion 124 of the actuator support bracket 100 to an extent determined by the stroke of pivotal movement of the support bracket 100 relative to the mounting bracket 46.

The mounting panel 46 has a hole 126 (defining one open end of the tubular member 42) through which the leading head portion 30 and annular groove portion 32 of shaft member 26 may pass when the security grille 14, 82 is in the locked position. A catch portion 128 of the actuator support bracket 100 has an arcuately cut-out edge surface 130 that is adapted to abut against the correspondingly curved, annular groove portion 32 of shaft member 26 when the security grille 14, 82 is in the locked position.

There is a coil spring 132 connected at a first one of its hooked ends 134 to a slotted reference tab 136 projecting from mounting panel 46 and connected at its other hooked end 138 to a slot 140 through the first limb portion 124 of the actuator support bracket 100. The coil spring 132 applies a constant spring bias so as to urge the actuator support bracket 100 to pivot in an anticlockwise direction about pivot axis 110 by reference to FIGS. 6, 7 and 9. However, the spring bias applied to the actuator support bracket 100 only operates within a limited pivoting stroke determined by upward and downward stop arrangements.

The pivoting stroke of the actuator support bracket 100 is limited in its upward extent by abutment of the edge surface 130 of catch portion 128 against the annular groove portion 32 of shaft member 26 when the security grille 14, 82 is in the locked position.

The actuator support bracket 100 has a second limb portion 142 which has a spacer part 143 and a stop support part 144 bent perpendicularly thereto. The stop support part 144 has an aperture 146 therethrough and the catch portion 128 has a similarly sized aperture 148 therethrough, both apertures 146,148 being horizontally aligned with each other and with a similarly sized depression 150 in the mounting panel 46. A stop pin 152 is adapted to slide through the apertures 146,148 and has an end 149 thereof adapted to engage within the depression 150 when the security grille 14, 82 is in the opened position. There is a push plate 154 welded to the slidable stop pin 152 and located substantially between the catch portion 128 and stop support part 144 of the second limb portion 142 of the actuator support bracket 100. The push plate 154 extends across the front of the leading head portion 30 and is adapted to abuttingly receive, and be pushed by, the leading head portion 30 in order to facilitate locking of the security grille 14, 82. There is a coil spring 156 axially and compressingly fitted around that part of the stop pin 152 located between the push plate 154 and stop support part 144, so as to apply a constant spring bias outwardly in both of its axial directions against the stop support part 144 (in one direction), and against the push plate 154 (in the other direction) so as to urge the push plate 154 (and slidable stop pin 152, to which the push plate 154 is welded) to slide in a direction towards and against the leading head portion 30 (when the security grille 14, 82 is in the locked position) and to urge the stop pin 152 to slide in a direction towards and into the depression 150 (when the security grille 14, 82 is in the opened position).

The pivoting stroke of the actuator support bracket 100 is limited in its downward extent by engagement of the stop pin 152 with the first depression 150 in the mounting panel 46.

A solenoid 158 is fixed by screws 160,161 through screw holes 162, 163 in the first limb portion 124 and through screw holes 164, 165 in the upper wall 166 of a solenoid support bracket 167 to the actuator support bracket 100 so that the solenoid 158 is pivotable with the support bracket 100. The solenoid rod 168, retractable by action of the solenoid 158, has a coil spring 170 axially and compressably fitted around that part of the solenoid rod 168 located between a rear wall 172 of the solenoid support bracket 167 and a press arrangement formed by a screw 174 passed diametrically through an aperture 176 in the solenoid rod 168 and secured thereto by a nut 178, together with a washer 180. The coil spring 170 applies a constant spring bias outwardly in both of its axial directions against the rear wall 172 of the solenoid support bracket 167, which is stationary (in one direction), and against the press arrangement (in the other direction) so as to urge the solenoid rod 168 (and press arrangement) to extend in a direction towards and into a similarly sized depression 182 in the mounting plate 46 (when the security grille 14, 82 is in the closed position).

The retraction of the solenoid rod 168 is controlled by power supplied to the solenoid 158 from the one or more batteries 59 and by the correct punching of a pre-programmed numerical code into either of the key pads 52, 66 via the circuit board 60 and connecting wiring 184.

In summary, when the locking mechanism (and hence the security grille) is in the locked position, the actuator support bracket 100 is effectively prevented from pivotally moving in an anticlockwise (upward) direction about pivot axis 110 under the compressive influence of the coil spring 132 by virtue of the abutment of the edge surface 130 of catch portion 128 against the annular groove portion 32 of shaft member 26 (at which position solenoid rod 168 is engaged with the depression 182 in the mounting panel 46). Note that the stop pin 152 is not engaged with the depression 150 at this stage. The actuator support bracket 100 is effectively prevented from pivotally moving in a clockwise (downward) direction about pivot axis 110 against the compressive influence of the coil spring 132 by virtue of the engagement of the solenoid rod 168 with the depression 182. Note that no amount of turning the handle 54 will cause the actuator support bracket 100 to pivot either anticlockwise or clockwise when the locking mechanism (and hence the security grille) is in the locked position.

In order to cause the locking mechanism to acquire the unlocked position (and so unlock the security grille), the user punches the correct code into either of the key pads 52, 66 which causes the solenoid rod 168 to retract from the depression 182, thus freeing the actuator support bracket 100 from any impediment to pivoting in a clockwise direction when the user turns the handle 54 clockwise against the compressive influence of coil spring 132. The actuator support bracket 100 will pivot in a clockwise direction until the stop pin 152 engages with the depression 150 in the mounting panel 46 under the expansive influence of the coil spring 156, at which position the catch portion 128 of the actuator support bracket 100 is spaced far enough apart from the annular groove portion 32 of shaft member 26 that shaft member 26, and the locking shaft structure 21 in its entirety, can be passed through the passageway 34, thus enabling the security grille to be pivotally opened. The locking shaft structure 21 is assisted to pass through the passageway 34 by a slight push provided by the push plate 154 when the stop pin 152 enters the depression 150. Thus unlocked, the locking shaft structure 21 exits the passageway 34 through flanged piece 40 in the outside wall and the security grille can be opened fully about its hinge structures 16, 18 to facilitate emergency evacuation of persons from the building or entry of emergency personnel into the building.

In order to cause the locking mechanism to acquire the locked position (and so lock the security grille), the user passes the locking shaft structure 21 into the passageway 34 and pushes the security grille shut so that the force applied in shutting the security grille is transferred through the locking shaft structure 21 against the push plate 154, which compresses the coil spring 156. As the push plate 154 is urged towards the stop support part 144, the slidable stop pin 152 is urged out of its engagement with the depression 150, thus freeing the actuation support bracket 100 from any impediment to pivoting in an anticlockwise direction about pivot axis 110 under the compressive influence of the coil spring 132. At the time when the stop pin 152 is no longer engaged within the depression 150, the leading head portion 30 of the shaft member 26 has been pushed past the edge surface 130 of catch portion 128 so that, when the actuator support bracket 100 pivots in an anticlockwise direction about pivot axis 1 10 under the compressive influence of the coil spring 132, the edge surface 130 of catch portion 128 is caused to abut against the annular groove portion 32 of shaft member 26, thus preventing the actuator support bracket 100 from any further pivotal movement in such direction.

Various modifications may be made in details of design and construction without departing from the scope and ambit of the invention.

I claim:

1. A locking assembly for a pivotally openable window or door security grille of a building, comprising:

an electronic punch key pad operable from within the building, a solenoid means having a solenoid rod retractable by operation of the electronic punch key pad, a locking shaft means secured at a first end thereof to the security grille, and including a shaft member at its second end thereof, the shaft member adapted to reach a lockable location when the security grille is pivoted from an opened position to a closed position, an actuator support bracket to which the solenoid means is mounted, the actuator support bracket being adapted to pivot in a forward direction from a first reference location to a second reference location so as to facilitate unlocking of the security grille and to pivot in a reverse direction from the second reference location to the first reference location so as to facilitate locking of the security grille, the actuator support bracket also having mounted thereon a slidable pin adapted to extend in a first longitudinal direction under the influence of first spring bias means and to retract in a second longitudinal direction opposite the first longitudinal direction under force applied by the shaft member of the locking shaft means when the security grille is pivoted from the opened position to the closed position, the actuator support bracket further including a catch surface adapted to engage against the shaft member of the locking shaft means so as to prevent the shaft member leaving the lockable location, first stop means for controllably preventing the actuator support bracket pivoting in the forward direction from the first reference location to the second reference location, second stop means for controllably preventing the actuator support bracket pivoting in the reverse direction from the second reference location to the first reference location, handle means operable from within the building to enable the actuator support bracket to pivot from the first reference location to the second reference location, and second spring bias means adapted to oppose the actuator support bracket pivoting from the first reference location to the second reference location when the first stop means no longer prevents the actuator support bracket pivoting in the forward direction, the arrangement being such that; to unlock the security grille, a user operates the electronic punch key pad to cause the solenoid rod to disengage the first stop means and then operates the handle means to cause the actuator support bracket to pivot in the forward direction from the first reference location to the second reference location against the influence of the second spring bias means, whereby the catch surface no longer engages against the shaft member which is free to leave the lockable location and allow the security grille to be pivoted to an opened position, and whereafter the slidable pin engages the second stop means under the influence of the first spring bias means; and to lock the security grille, the user pivots the security grille to a closed position so as to cause the shaft member to apply a force against the slidable pin that disengages the slidable pin from the second stop means against the opposing influence of the first spring bias means, whereby the actuator support bracket is caused to pivot in the reverse direction from the second reference location to the first reference location under the influence of the second spring bias means until the catch surface engages against the shaft member so as to prevent the shaft member leaving the lockable location, and whereafter the solenoid rod reengages the first stop means.

2. The locking assembly of claim 1 and further including a second electronic punch key pad and a second handle means, both of which are operable from outside the building, and including means for enabling operation of the second electronic punch key pad to disengage the solenoid rod from the first stop means, and including means for enabling operation of the second handle means to pivot the actuator support bracket from the first reference location to the second reference location.

3. The locking assembly of claim 1 wherein the shaft member leaves the lockable location under the influence of the first spring bias means.

4. The locking assembly of claim 1 wherein each of the first and second spring bias means comprise a spring coil.

5. The locking assembly of claim 1 wherein the first stop means comprises a first depression formed within a panel of a housing for the actuator support bracket, the solenoid rod being adapted to retractably engage within the first depression.

6. The locking assembly of claim 5 wherein the second stop means comprises a second depression formed within the panel, the slidable pin being adapted to retractably engage within the second depression.

7. The locking assembly of claim 1 wherein the handle means is pivotable about a first axis and includes an arm means that applies force against the actuator support bracket when the handle means is pivoted, the force so applied by the arm means causing the actuator support bracket to pivot about a second axis which is parallel with the first axis.

* * * * *